US010533236B2

(12) United States Patent
Funakawa et al.

(10) Patent No.: US 10,533,236 B2
(45) **Date of Patent: *Jan. 14, 2020**

(54) HIGH-STRENGTH HOT ROLLED STEEL SHEET AND METHOD FOR MANUFACTURING THE SAME

(71) Applicant: JFE Steel Corporation, Tokyo (JP)

(72) Inventors: Yoshimasa Funakawa, Fukuyama (JP); Tetsuo Yamamoto, Bangkok (TH); Hiroshi Uchomae, Kawasaki (JP); Hiroshi Nakano, Kurashiki (JP); Taro Kizu, Kawasaki (JP)

(73) Assignee: JFE Steel Corporation, Tokyo (JP)

( * ) Notice: Subject to any disclaimer, the term of this patent is extended or adjusted under 35 U.S.C. 154(b) by 276 days.

This patent is subject to a terminal disclaimer.

(21) Appl. No.: 15/484,171

(22) Filed: Apr. 11, 2017

(65) Prior Publication Data

US 2017/0218474 A1 Aug. 3, 2017

Related U.S. Application Data

(62) Division of application No. 14/369,269, filed as application No. PCT/JP2012/008003 on Dec. 14, 2012, now Pat. No. 9,657,382.

(30) Foreign Application Priority Data

Dec. 27, 2011 (JP) ..... 2011-284685

(51) Int. Cl.

| | |
|---|---|
| ***C21D 9/46*** | (2006.01) |
| ***C21D 8/02*** | (2006.01) |
| ***C21D 8/04*** | (2006.01) |
| ***C22C 38/00*** | (2006.01) |
| ***C22C 38/14*** | (2006.01) |
| ***C22C 38/02*** | (2006.01) |
| ***C22C 38/04*** | (2006.01) |
| ***C22C 38/06*** | (2006.01) |
| ***C22C 38/60*** | (2006.01) |
| ***C22C 38/08*** | (2006.01) |
| ***C22C 38/10*** | (2006.01) |
| ***C22C 38/12*** | (2006.01) |
| ***C22C 38/16*** | (2006.01) |
| ***C22C 38/22*** | (2006.01) |
| ***C22C 38/28*** | (2006.01) |

(52) U.S. Cl.

CPC ..... *C21D 9/46* (2013.01); *C21D 8/0226* (2013.01); *C21D 8/0247* (2013.01); *C21D 8/0263* (2013.01); *C21D 8/0415* (2013.01); *C21D 8/0426* (2013.01); *C21D 8/0463* (2013.01); *C22C 38/00* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/105* (2013.01); *C22C 38/12* (2013.01); *C22C 38/14* (2013.01); *C22C 38/16* (2013.01); *C22C 38/22* (2013.01); *C22C 38/28* (2013.01); *C22C 38/60* (2013.01); *C21D 2211/004* (2013.01); *C21D 2211/005* (2013.01); *Y10T 428/12799* (2015.01); *Y10T 428/12972* (2015.01)

(58) Field of Classification Search

CPC ..... C21D 2211/004; C21D 2211/005; C21D 8/0226; C21D 8/0263; C21D 8/0426; C21D 8/0463; C21D 9/46; C22C 38/00; Y10T 428/12799; Y10T 428/12972

USPC ..... 148/320

See application file for complete search history.

(56) References Cited

U.S. PATENT DOCUMENTS 6,669,789 B1 * 12/2003 Edelman ..... C21C 7/0006 148/320
9,657,382 B2 * 5/2017 Funakawa ..... C22C 38/001

FOREIGN PATENT DOCUMENTS

| | | | | |
|---|---|---|---|---|
| EP | 1 918 396 | A1 | | 5/2008 |
| JP | 2002-363693 | A | | 12/2002 |
| JP | 2003-293083 | A | | 10/2003 |
| JP | 2003293083 | A | * | 10/2003 |
| JP | 2003-321734 | A | | 11/2003 |
| JP | 2003-321735 | A | | 11/2003 |
| JP | 2003-321736 | A | | 11/2003 |
| JP | 2004-250743 | A | | 9/2004 |
| JP | 2005-054255 | A | | 3/2005 |

(Continued)

OTHER PUBLICATIONS

NPL: Machine translation of JP2003293083A, 2003 (Year: 2003).*

(Continued)

*Primary Examiner* — Jie Yang
(74) *Attorney, Agent, or Firm* — DLA Piper LLP (US)

(57) ABSTRACT

A method of manufacturing a high-strength hot rolled steel sheet by hot rolling a steel having a chemical composition including, by mass %: C: more than 0.010% and not more than 0.06%, Si: not more than 0.3%, Mn: not more than 0.8%, P: not more than 0.03%, S: not more than 0.02%, Al: not more than 0.1%, N: not more than 0.01% and Ti: 0.05 to 0.10%, the balance including Fe and inevitable impurities, including: after the steel is heated to an austenite single phase region, the steel is finish rolled at a finishing delivery temperature of 860° C. to 1050° C., the steel sheet is cooled at an average cooling rate of not less than 30° C./s in a temperature range of from a temperature after the completion of the finish rolling to 750° C., and the steel sheet is coiled into a coil at a coiling temperature of 580° C. to 700° C.

4 Claims, No Drawings

(56) References Cited

FOREIGN PATENT DOCUMENTS

| | | | |
|---|---|---|---|
| JP | 2007-247046 | A | 9/2007 |
| JP | 2007-308771 | A | 11/2007 |
| JP | 2010-53434 | A | 3/2010 |
| JP | 2010-255016 | A | 11/2010 |
| JP | 2011-012308 | A | 1/2011 |
| JP | 2011-026690 | A | 2/2011 |
| WO | 2011/162412 | A1 | 12/2011 |
| WO | 2011/162418 | A1 | 12/2011 |

OTHER PUBLICATIONS

Supplementary European Search Report dated Jan. 4, 2016 in corresponding European Application No. 12863851.7.
Korean Office Action dated Apr. 18, 2016 in corresponding Korean Appln. No. 2014-7019784 w/Concise Statement of Relevance (English).

* cited by examiner

HIGH-STRENGTH HOT ROLLED STEEL SHEET AND METHOD FOR MANUFACTURING THE SAME

TECHNICAL FIELD

This disclosure relates to high-strength thin steel sheets with a yield strength of not less than 530 MPa and excellent stretch flangeability suited as transportation machinery parts such as automobile parts and structural components such as building parts, and to methods of manufacturing such steel sheets. In particular, the disclosure relates to controlling variations in mechanical properties in individual steel sheets (coils). The term "steel sheets" includes steel strips.

BACKGROUND

From the viewpoint of global environmental preservation, the automobile industry recently remains confronted with an important challenge of enhancing the fuel efficiency of automobiles to reduce carbon dioxide $CO_2$ emissions. Saving weight in automobile bodies is an effective approach to improve automobile fuel efficiency. The weight reduction of car bodies needs to be accompanied by maintenance of the strength of automobile bodies. Lightweight car bodies may be realized without decreasing their strength by increasing the strength of steel sheets as automobile part materials so that the thickness of the materials can be reduced. From this viewpoint, there has recently been a very strong demand that such part materials have higher strength, resulting in an increasing use of high-strength thin steel sheets as such part materials.

However, application of high-strength steel sheets to such parts is frequently interfered with by the presence of variations in strength and workability in individual high-strength steel sheets, namely, variations in mechanical properties in individual steel sheets (steel strips). Variations in strength induce varied amounts of spring back to destabilize the shape of press-formed parts. Further, variations in strength give rise to variations in stretch flangeability and can cause fractures during press forming.

In general, variations in steel sheet strength are ascribed to variations in temperature history experienced in the rolling direction and in the width direction of the steel sheet during the manufacturing of steel sheets, and further ascribed to variations in steel sheet microstructure produced by differences in rolling conditions.

To address these problems, for example, Japanese Unexamined Patent Application Publication No. 2007-308771 describes a high-strength steel sheet with a tensile strength of not less than 500 MPa which includes not less than 60% of a ferrite phase. That steel sheet is characterized in that when the steel sheet is deformed with a strain of 20% or more, the deformed region contains at least 50% of ferrite crystal grains in which dislocation cell structures arranged in one direction intersect with other such structures in at least two directions. According to the technique described in JP '771, the amount of spring back that occurs after the forming of parts can be stably reduced, namely, parts with excellent shape fixability can be produced. However, the steel sheet according to that technique contains, in addition to ferrite, a hard phase that affects the strength of the steel sheet, and the amount of such a hard phase is caused to significantly fluctuate by differences in manufacturing conditions from place to place in the steel sheet during manufacturing on the industrial scale. This fact problematically causes significant variations in steel sheet strength within the steel sheet (the coil).

Japanese Unexamined Patent Application Publication No. 2004-250743 describes a high-workability high-strength hot rolled steel sheet with excellent shape fixability and small anisotropy. The high-strength hot rolled steel sheet obtained according to the technique of JP '743 has a microstructure containing a ferrite or bainite phase with the largest volume fraction or further contains 1 to 25% of martensite and retained austenite and in which a group of specific crystal orientations of the sheet surface at ½ sheet thickness has an average ratio of X-ray intensity to a random sample of not less than 2.5, specific three crystal orientations at ½ sheet thickness have an average ratio of X-ray intensity to a random sample of not more than 3.5, at least one of the r value in the rolling direction and the r value in a direction perpendicular to the rolling direction is not more than 0.7, and the anisotropy in uniform elongation ΔuEl is not more than 4% and not more than the anisotropy in local elongation ΔLEl. Those configurations allegedly realize thin steel sheets having good press formability with a small amount of spring back, namely, excellent shape fixability and also with small anisotropy. However, the technique described in JP '743 has problems in that the texture of the steel sheet cannot be obtained stably in the longitudinal direction and the width direction of the coil and further that the positive formation of martensite and retained austenite in the steel sheet microstructure results in a marked decrease in the stability of strength to make it very difficult to obtain stable shape fixability.

Japanese Unexamined Patent Application Publication No. 2003-321734 describes a high-formability high-tensile strength hot rolled steel sheet having excellent uniformity in quality. According to the technique described in JP '734, a steel containing C: not more than 0.1%, Ti: 0.02 to 0.2% and one or both of Mo and W to satisfy a specific relation of the Ti, Mo and W contents is hot rolled, coiled into a coil and heat treated to produce a steel sheet that has a microstructure substantially composed of ferrite in which a carbide precipitate containing titanium and one or both of molybdenum and tungsten is dispersed. That steel sheet is described as having an excellent uniformity in quality such that the difference in yield stress between a widthwise central portion and a widthwise end portion of the steel sheet is not more than 39 MPa. Although the technique described in JP '734 can reduce quality variations in the width direction to a certain extent, the segregation of manganese causes tensile strength to vary from place to place in the longitudinal direction of the steel sheet (the coil). Thus, the uniformity in quality remains to be improved.

Japanese Unexamined Patent Application Publication No. 2003-321735 describes a high-formability high-tensile strength steel sheet with excellent stability in strength. According to the technique described in JP '735, the steel sheet has a chemical composition including C: 0.03 to 0.15%, Mn: not less than 0.2%, N: not more than 0.01%, Ti: 0.05 to 0.35% and one or both of Mo: not more than 0.6% and W: not more than 1.5%, the contents of molybdenum and tungsten, when contained solely, being Mo: not less than 0.1% and W: not less than 0.2%, the Ex. C content (the content of carbon not bonded to titanium, molybdenum or tungsten) being not more than 0.015%, the Mn content satisfying a specific relationship with the Ex. C content. Further, the steel sheet has a microstructure substantially composed of ferrite in which a precipitate with a size of less than 10 nm containing titanium and one or both of molybdenum and tungsten is dispersed. According to that disclosure, the high-tensile strength steel sheet having the above configurations exhibits a tensile strength of not less than 550 MPa and achieves excellent strength stability. When, however, the Mn content is 1% or more, the steel sheet decreases strength stability due to the segregation of manganese and cannot maintain the stability of strength in the width direction.

Japanese Unexamined Patent Application Publication No. 2002-363693 describes a high-stretch flangeability steel sheet with excellent shape fixability. According to the technique described in JP '693, the steel sheet is configured such that a ferrite or bainite phase has the largest area fraction, the occupancy proportion of iron carbide in grain boundaries is not more than 0.1, the maximum particle size of the iron carbide is not more than 1 μm, the steel sheet has a texture in which crystals with specific orientations are aligned in parallel with at least the sheet plane at the center of the sheet thickness, and the r value is controlled in a specific range. Those configurations are described as reducing the amount of spring back and improving shape fixability. However, it is difficult with the technique of JP '693 to stably ensure the specific texture in the longitudinal direction and in the width direction of the coil. Thus, a difficulty remains in obtaining steel sheets with stable strength.

Japanese Unexamined Patent Application Publication No. 2011-26690 describes a low-alloy high-strength hot rolled steel sheet containing, by mass %, C: 0.02 to 0.08%, Si: 0.01 to 1.5%, Mn: 0.1 to 1.5% and Ti: 0.03 to 0.06%, the ratio of the Ti content to the C content being controlled to Ti/C: 0.375 to 1.6, and in which the size and the average number density of TiC are 0.8 to 3 nm and not less than $1\times10^{17}$ particles/$cm^3$, the steel sheet having a tensile strength of 540 to 650 MPa. According to the technique described in JP '690, TiC is finely dispersed by performing coiling at a temperature of not more than 600° C., thereby ensuring a high strength of not less than 540 MPa in terms of tensile strength. However, although the size of the precipitate is limited to 0.8 to 3 nm, significant fluctuations are caused in terms of yield strength which is more sensitive to variations in the size of precipitates than tensile strength. Further, as illustrated in EXAMPLES of JP '690, ensuring a tensile strength of not less than 590 MPa requires a coiling temperature of not more than 575° C. and also a Mn content of not less than 1% or a C content of not less than 0.07%. Thus, the disclosed technique has a problem in that strength cannot be obtained stably.

Japanese Unexamined Patent Application Publication No. 2007-247046 describes a high-strength steel sheet with excellent strength-ductility balance. The technique described in JP '046 resides in a hot rolled steel sheet with excellent strength-ductility balance which contains, by mass %, C: 0.01 to 0.2%, Mn: 0.20 to 3% and one, or two or more of Ti: 0.03 to 0.2%, Nb: 0.01 to 0.2%, Mo: 0.01 to 0.2% and V: 0.01 to 0.2%, and is configured such that the steel sheet includes a ferrite single phase microstructure that contains two kinds of crystal grains, namely, hard ferrite crystal grains A and soft ferrite crystal grains B having different number densities of 8 nm or finer precipitate or cluster particles in the crystal grains. That technique simulates and reproduces the working hardening behavior of DP steel by changing the hardnesses of the crystal grains. However, the technique of JP '046 involves a large amount of silicon or aluminum singly or in combination with each other, and describes that the use of such large amounts of silicon and aluminum is essential to achieve the distribution of 8 nm or finer precipitate or cluster particles satisfying the prescribed number densities. According to the technique of JP '046, a Mn content of 0.87% or above is required to ensure strength as illustrated in its EXAMPLES. Further, the technique described in JP '046 has a problem in that controlling of the cluster distributions in the respective crystal grains is contributory to the development of variations in strength among the crystal grains, and consequently the coil fails to attain stable quality.

JP '771, JP '743, JP '734, JP '735, JP '693, JP '690 and JP '046 assert that higher strength and improvements in workability and shape fixability are generally expected according to the techniques described therein. However, individual steel sheets (coils) obtained by any of those techniques show significant variations in strength. Because of the instability in strength, parts (components) fabricated from a single steel sheet (coil) have different dimensional accuracies. Thus, it has been difficult to manufacture parts with stable dimensional accuracy.

It could therefore be helpful to provide high-strength hot rolled steel sheets with excellent stretch flangeability which have small variations in mechanical properties in individual coils and thus allow parts to be fabricated therefrom with stable dimensional accuracy, and also to provide methods of manufacturing such steel sheets. The term "high-strength hot rolled steel sheets" refers to hot rolled steel sheets with high strength which have a yield strength YS of not less than 530 MPa and preferably have a tensile strength TS of not less than 590 MPa. The phrase "having small variations in mechanical properties in individual coils" means that the difference in yield strength YS, ΔYS, between a widthwise central portion and a widthwise end portion of a steel strip in the form of a coil is not more than 20 MPa as will be described later in the EXAMPLES.

Summary

We thus provide:

(1) A high-strength hot rolled steel sheet with a yield strength of not less than 530 MPa, the steel sheet having a chemical composition including, by mass %, C: more than 0.010% and not more than 0.06%, Si: not more than 0.3%, Mn: not more than 0.8%, P: not more than 0.03%, S: not more than 0.02%, Al: not more than 0.1%, N: not more than 0.01% and Ti: 0.05 to 0.10%, the balance comprising Fe and inevitable impurities, the steel sheet including a metal microstructure containing a ferrite phase with an area ratio of not less than 95%, the ferrite crystal grains having an average grain size of not less than 1 μm, the ferrite crystal grains containing TiC precipitate particles dispersed in the crystal grains, the TiC precipitate particles having an average particle size of not more than 7 nm.

(2) The high-strength hot rolled steel sheet described in (1), wherein the chemical composition further includes, by mass %, B: not more than 0.0020%.

(3) The high-strength hot rolled steel sheet described in (1) or (2), wherein the chemical composition further includes, by mass %, one or more selected from the group consisting of Cu, Ni, Cr, Co, Mo, Sb, W, As, Pb, Mg, Ca, Sn, Ta, Nb, V, REM, Cs, Zr and Zn in a total content of not more than 1%.

(4) The high-strength hot rolled steel sheet described in any of (1) to (3), wherein the TiC has a ratio of the number of Ti atoms to the number of C atoms, Ti/C, of less than 1.

(5) The high-strength hot rolled steel sheet described in any of (1) to (4), having a coating on the surface.

(6) The high-strength hot rolled steel sheet described in (5), wherein the coating is a zinc coating or a zinc-containing alloy coating.

(7) A method of manufacturing high-strength hot rolled steel sheets with a yield strength of not less than 530 MPa, including subjecting a steel to hot rolling including rough rolling and finish rolling, cooling after the completion of finish rolling, and coiling, thereby producing a hot rolled steel sheet, wherein the steel has a chemical composition including, by mass %, C: more than 0.010% and not more than 0.06%, Si: not more than 0.3%, Mn: not more than 0.8%, P: not more than 0.03%, S: not more than 0.02%, Al: not more than 0.1%, N: not more than 0.01% and Ti: 0.05 to 0.10%, the balance comprising Fe and inevitable impurities, the hot rolling is performed after the steel is heated to an austenite single phase region, the finishing delivery temperature in the finish rolling is 860° C. to 1050° C., the steel sheet is cooled at an average cooling rate of not less than 30° C./s in the temperature range of from a temperature after the completion of the finish rolling to 750° C., and the steel sheet is coiled into a coil at a coiling temperature of 580° C. to 700° C.

(8) The method of manufacturing high-strength hot rolled steel sheets described in (7), wherein the chemical composition further includes, by mass %, B: not more than 0.0020%.

(9) The method of manufacturing high-strength hot rolled steel sheets described in (7) or (8), wherein the chemical composition further includes, by mass %, one or more selected from the group consisting of Cu, Ni, Cr, Co, Mo, Sb, W, As, Pb, Mg, Ca, Sn, Ta, Nb, V, REM, Cs, Zr and Zn in a total content of not more than 1%.

We produce high-strength hot rolled steel sheets with excellent stretch flangeability and having small variations in mechanical properties in individual coils while maintaining a high strength of not less than 530 MPa in terms of yield strength. Further, our steel sheets allow parts to be manufactured with stable dimensional accuracy, contributing to the weight saving of automobile bodies and the weight reduction of products.

DETAILED DESCRIPTION

In general, the dimensional accuracy of press-formed parts is evaluated based on the amount of spring back. Parts are evaluated to have stable dimensional accuracy when the amount of spring back is constant in a group of parts of the same kind. The amount of "spring back" indicates the amount of recovery that occurs when the deforming stress is released after the steel is worked. Since the amount of spring back depends on the yield strength of steel, it is necessary that the steel have constant yield strength to give parts with stable dimensional accuracy.

We studied various factors that give rise to strength variations in a coil of a highly strengthened hot rolled steel sheet with a yield strength of not less than 530 MPa. As a result, we found that variations in the size and the distribution state of hard phases are one of the factors causing strength variations. To restrain formation of hard phases, we then concluded that the metal microstructure should be substantially a ferrite single phase microstructure composed of a collection of ferrite crystal grains. Highly strengthened hot rolled steel sheets having a yield strength of not less than 530 MPa often contain various kinds of phases in the microstructures of the steel sheets. The strength of such steel sheets is significantly varied by the differences in the fractions and in the hardnesses among the phases. We then thought that this development of strength variations would not be easily suppressed as long as the metal microstructure is a multiple phase microstructure including various kinds of phases, and have reached the conclusion that the metal microstructure should be of a single phase.

Further, we assumed that, in a microstructure in which the grain size is refined, even slight variations in crystal grain size would be a powerful factor in the development of strength variations. Thus, we concluded that the crystal grains should not be positively refined. We then reached the finding that, in steel sheets including a ferrite single phase microstructure without strengthening by extreme grain size refinement, the major factors in the occurrence of strength variations are the fluctuations in the size and the amount in which carbides are precipitated.

We further found that the development of fluctuations in the size and amount of carbide precipitates is ascribed to carbide precipitation occurring at various times. We still further found that variations in the timing of carbide precipitation may be remedied by decreasing the Si and Mn contents.

Specifically, we first found that the tensile strength becomes varied in the width direction when steel contains a large amount of manganese, concluding that the Mn content should be reduced. If steel contains a large amount of manganese, the timing of carbide precipitation is delayed at a region where manganese has been segregated. Further, solid solution strengthening by manganese increases the hardness of that region to an abnormal level. For these reasons, we found that a Mn content of 0.8% or more, which has been considered normal in the conventional high-strength steel sheets, causes significant variations in strength. We further found that, similarly to manganese, silicon present in a conventional amount of 0.3% or more can be a factor in the development of variations in steel sheet microstructure, namely, variations in strength.

Based on the above, we found that by reducing the Si and Mn contents, by configuring the microstructure to be substantially composed of a ferrite phase alone, and further by dispersing ultrafine TiC in the ferrite crystal grains of the ferrite phase, the size and the amount of carbide precipitate may be controlled to be constant throughout a steel sheet (a coil) and a high-strength hot rolled steel sheet may be obtained which achieves markedly small strength variations in the steel sheet (the coil) while maintaining a high strength of not less than 530 MPa in terms of yield strength. The phrase "substantially composed of a ferrite single phase" and similar expressions indicate that the ferrite crystal grains represent 95% or more of the metal microstructure observed with an optical microscope and a scanning electron microscope at magnifications of 500 to 5000 times.

Our hot rolled steel sheets have a chemical composition including C: more than 0.010% and not more than 0.06%, Si: not more than 0.3%, Mn: not more than 0.8%, P: not more than 0.03%, S: not more than 0.02%, Al: not more than 0.1%, N: not more than 0.01% and Ti: 0.05 to 0.10%, the balance comprising Fe and inevitable impurities.

First, the reasons why the chemical composition of the hot rolled steel sheets is limited will be described. In the following description, mass % will be simply written as unless otherwise mentioned.

C: more than 0.010% and not more than 0.06%

Carbon contributes to strengthening by being precipitated in the form of carbide with titanium (TiC). The C content needs to be higher than 0.010% to obtain this effect. Any C content that is 0.010% or below cannot ensure a high strength of not less than 530 MPa in terms of yield strength. If the C content exceeds 0.06%, pearlite is formed to lower the stability of strength and causes a decrease in stretch flangeability. Thus, the C content is limited to more than 0.010% and not more than 0.06%. The C content is preferably more than 0.010% and not more than 0.025%.

Si: not more than 0.3%

Silicon is a conventional useful element which increases the strength of steel sheets without lowering elongation. Herein, however, silicon increases hardenability to promote formation of hard phases such as martensite and bainite, exerting a large influence in the development of strength variations in steel sheets. Thus, it is desirable that silicon be reduced as much as possible. However, up to 0.3% silicon is acceptable, and thus the Si content is limited to not more than 0.3%. The Si content is preferably not more than 0.2%, and more preferably not more than 0.1%. The Si content may be zero without any problems.

Mn: not more than 0.8%

Similarly to silicon, manganese is positively added in conventional steel to increase the strength of steel sheets by solid solution strengthening. However, similarly to silicon, manganese increases hardenability to promote formation of hard phases such as martensite and bainite, exerting a large influence on the development of strength variations in steel sheets. Further, manganese is prone to segregation. At regions where manganese has been segregated (segregation regions), the transformation point is locally lowered and hard phases are formed to cause a local increase in strength. As a result, strength variations are produced in a steel sheet (a coil) and the stability of strength is lowered. For these reasons, the Mn content is desirably reduced as much as possible. However, up to 0.8% manganese is acceptable, and thus the Mn content is limited to not more than 0.8%. The Mn content is preferably 0.15 to 0.55%.

P: not more than 0.03%

In steel sheets, phosphorus is segregated in grain boundaries such as ferrite grain boundaries to lower stretch flangeability. Thus, this element is desirably reduced as much as possible. However, up to 0.03% phosphorus is acceptable. Thus, the P content is limited to not more than 0.03%. The P content is preferably not more than 0.02%, and more preferably not more than 0.01%. The P content may be zero without any problems.

S: not more than 0.02%

Sulfur consumes titanium by forming TiS, serving as a factor in the development of strength variations. This function becomes marked when the S content exceeds 0.02%. Thus, the S content is limited to not more than 0.02%. The S content is preferably not more than 0.005%, and more preferably not more than 0.001%. The S content may be zero without any problems.

Al: not more than 0.1%

Aluminum functions as a deoxidizer. The Al content is desirably not less than 0.005% to obtain this effect. On the other hand, aluminum, when added in excess of 0.1%, remains in steel in the form of aluminum oxide and tends to be aggregated to form coarse aluminum oxide (alumina). Coarse aluminum oxide serves as a starting point for fractures, and facilitates the occurrence of strength variations. From the viewpoint of ensuring stability in strength, the Al content is limited to not more than 0.1%. The Al content is preferably 0.015 to 0.065%.

N: not more than 0.01%

Nitrogen bonds to titanium in steel to form TiN. If the N content is in excess of 0.01%, the amount of titanium available for the formation of carbide is lowered by nitridation, failing to ensure the desired high strength. The precipitation of coarse TiN is a result of the consumption of titanium, and the amount of fine TiC precipitate responsible for strengthening is decreased. In addition to this role in the development of strength variations, coarse TiN tends to serve as a starting point for fractures during working. That is, stretch flangeability is lowered. Accordingly, nitrogen is a harmful element and desirably reduced as much as possible. For these reasons, the N content is limited to not more than 0.01%. The N content is preferably not more than 0.006%. The N content may be zero without any problems.

Ti: 0.05 to 0.10%

Titanium is an important element to ensure the desired high strength. Titanium increases the strength of steel sheets by forming fine TiC. The Ti content needs to be not less than 0.05% to obtain this effect. If the Ti content is less than 0.05%, the desired high strength, namely, 530 MPa or more yield strength cannot be ensured. If the Ti content exceeds 0.10%, the amount of solute titanium is so increased that the coarsening of TiC cannot be suppressed and the desired high strength cannot be ensured. For these reasons, the Ti content is advantageously limited to 0.05 to 0.10%. Substantially the whole of titanium added forms Ti-containing precipitates, and the amount of solute titanium is not more than 0.001%.

While the aforementioned components are the basic components, the steel may further contain 0.0020% or less boron as a selective element in addition to the basic components as required.

B: not more than 0.0020%

Boron is dissolved in steel to retard the austenite ($\gamma$) to ferrite ($\alpha$) transformation and allow TiC to be finely precipitated. The B content is desirably not less than 0.0010% to obtain these effects. If the B content exceeds 0.0020%, however, the $\gamma$ to $\alpha$ transformation is suppressed to an excessive extent and formation of phases such as bainite is facilitated, resulting in a decrease in stretch flangeability and also a decrease in the stability of strength in the width direction of the steel sheet. Thus, the content of boron, when present, is preferably limited to not more than 0.0020%.

In addition to the aforementioned components, the steel may further contain one or more of the group consisting of Cu, Ni, Cr, Co, Mo, Sb, W, As, Pb, Mg, Ca, Sn, Ta, Nb, V, REM, Cs, Zr and Zn in a total content of not more than 1%. The presence of these elements is acceptable as long as the total content thereof is 1% or below because the influence of these elements on the advantageous effects is small. The balance after deduction of the aforementioned components is iron and inevitable impurities.

Next, there will be described the reasons why the microstructure of the hot rolled steel sheets is limited.

The hot rolled steel sheet has the aforementioned chemical composition and includes a metal microstructure in which a ferrite phase represents an area ratio of not less than 95%. In the metal microstructure, the ferrite crystal grains in the ferrite phase have an average crystal grain size of not less than 1 μm, and the ferrite crystal grains contain TiC precipitate particles with an average particle size of not more than 7 nm dispersed in the crystal grains.

Metal Microstructure: Ferrite Phase Area Ratio of not less than 95%

It is important that the metal microstructure be substantially composed of a ferrite single phase formed of ferrite crystal grains. If the microstructure contains large amounts of hard phases such as martensite phase and bainite phase in addition to the ferrite phase, the strength is varied in accordance with the fractions of such phases. Thus, the metal microstructure is to be substantially composed of a ferrite single phase to control strength variations in the steel sheet (the coil). The phrase "substantially composed of a ferrite single phase" comprehends cases in which the area ratio of the ferrite phase to the entire microstructure is 100% as well as cases in which the area ratio of the phase to the entire microstructure is 95% or more, and preferably more than 98%. The term "metal microstructure" indicates a metal microstructure observed with an optical microscope and a scanning electron microscope at magnifications of 500 to 5000 times.

Average Crystal Grain Size of Ferrite Crystal Grains: not less than 1 μm

Factors that will give rise to strength variations are eliminated as much as possible to reduce strength variations in the coil (the steel sheet). Thus, our methods do not involve positive refinement of crystal grains which is an effective approach to increasing strength. Strengthening by grain size refinement sharply increases its effect when the ferrite crystal grains are refined to such an extent that the grain size is less than 1 μm. As a result, the magnitude of strength comes to be markedly dependent on the ferrite crystal grain size, and large strength variations are caused by slight changes in crystal grain size in the coil (the steel sheet). For these reasons, the average grain size of the ferrite crystal grains is limited to not less than 1 μm.

Average Particle Size of TiC Precipitated in Ferrite Crystal Grains: not more than 7 nm A high strength of not less than 530 MPa in terms of yield strength is obtained by precipitating fine titanium carbide (TiC) in the ferrite crystal grains. Because strengthening involves only controlling of the precipitation of fine carbide, the desired strength may be stably ensured. If the average TiC particle size exceeds 7 nm, it becomes difficult to ensure a high strength of not less than 530 MPa in terms of yield strength. Thus, the average TiC particle size is limited to not more than 7 nm.

Number Ratio Ti/C of Ti Atoms to C Atoms in TiC: less than 1

The ratio of the number of Ti atoms to the number of C atoms in titanium carbide (TiC) is important for TiC to be finely precipitated. The titanium carbide (TiC) tends to be coarsened if titanium atoms are present in excess over carbon atoms in the carbide during the precipitation of TiC. It is therefore preferable that the number ratio of Ti atoms to C atoms, Ti/C, in TiC be limited to less than 1. Although slight amounts of niobium, vanadium, molybdenum and tungsten are often dissolved in TiC, TiC containing such solute Nb, V, Mo and W is written as TiC. Since titanium is a relatively inexpensive element, it is advantageous in terms of cost saving that fine carbide-forming elements other than titanium, namely, molybdenum, tungsten, niobium and vanadium mentioned as selective elements hereinabove be not added (so that the contents of these elements will be impurity levels).

To impart corrosion resistance to the steel sheets, a coating may be formed on the surface of the steel sheets. The advantageous effects are not impaired even when a coating is formed on the surface of the hot rolled steel sheets. The types of the coatings formed on the surface are not particularly limited, and any coatings such as electroplated coatings and hot dip coatings may be applied without problems. Examples of the hot dip coatings include hot dip zinc coatings and hot dip aluminum coatings. After hot dipping a zinc coating, the hot dip zinc coating may be subjected to an alloying treatment to form a galvannealed zinc coating without causing any problems. The upper limit of the strength of the hot rolled steel sheets is not particularly specified. However, as apparent from the EXAMPLES described later, the steel sheets preferably have a TS of not more than 750 MPa, or not more than 725 MPa.

Next, a preferred method of manufacturing the hot rolled steel sheets will be described.

In a manufacturing method, a steel is subjected to hot rolling including rough rolling and finish rolling, cooling after the completion of finish rolling, and coiling, thereby producing a hot rolled steel sheet. The method is characterized in that the hot rolling is performed after the steel is heated to an austenite single phase region, the finishing delivery temperature in the finish rolling is not more than 1050° C., the steel sheet is cooled at an average cooling rate of not less than 30° C./s in the temperature range of from a temperature after the completion of the finish rolling to 750° C., and the steel sheet is coiled into a coil at a coiling temperature of 580° C. to 700° C.

The steel may be smelted by any method without limitation. Preferably, a molten steel having the aforementioned chemical composition is smelted in a usual smelting furnace such as a converter furnace or an electric furnace, and is processed into a form such as slab by a usual casting method such as a continuous casting method. Other common casting methods such as ingot making-blooming methods and thin slab continuous casting methods may be used.

The steel obtained as described above is subjected to rough rolling and finish rolling. Prior to rough rolling, the steel is heated to an austenite single phase region. If the steel to be rough rolled is not heated to an austenite single phase region, re-dissolution of TiC present in the steel does not proceed and thus fine precipitation of TiC is not achieved after the rolling. To avoid this, the steel is heated to an austenite single phase region prior to rough rolling. The heating temperature is preferably not less than 1100° C. Heating at an excessively high temperature oxidizes the surface to an excessive extent and titanium is consumed by the formation of $TiO_2$. Consequently, the obtainable steel sheet suffers a decrease in hardness near the surface. Thus, the heating temperature is preferably not more than 1300° C. Direct rolling (process) may be adopted without heating the steel after the steel is cast. The rough rolling conditions are not particularly limited.

Finishing Delivery Temperature: 860° C. to 1050° C.

If the finishing delivery temperature is higher than 1050° C., the ferrite crystal grains tend to be coarsened to cause a marked decrease in the strength of steel sheets. Thus, the finishing delivery temperature is limited to not more than 1050° C. If the finishing delivery temperature is less than 860° C., the final ferrite grains have sizes of less than 1 μm and such refinement of crystal grains exerts a marked effect to give rise to large strength variations in the steel sheet. Thus, the finishing delivery temperature is limited to not less than 860° C., and is preferably not less than 900° C.

Average Cooling Rate in Temperature Range of from Temperature after Completion of Finish Rolling to 750° C.: not less than 30° C./s It is necessary that the finish rolled steel sheet be subjected to accelerated cooling to allow the γ to α transformation to take place at as low a temperature as possible to obtain fine TiC. Slow cooling at a rate of less than 30° C./s causes the γ to α transformation to occur at a high temperature, and TiC precipitated in the ferrite tends to be coarse, namely, fine TiC is difficult to form. For these reasons, the average cooling rate in the temperature range of from a temperature after the completion of the finish rolling to 750° C. is limited to not less than 30° C./s, and is preferably not less than 50° C./s. The upper limit of the cooling rate is preferably 450° C./s or below because any higher cooling rate tends to cause nonuniformity of cooling in the width direction.

Coiling Temperature: 580° C. to 700° C.

If the coiling temperature is less than 580° C., formation of bainitic ferrite and bainite is induced to make it difficult to obtain a microstructure substantially composed of a ferrite single phase. Thus, the coiling temperature is limited to not less than 580° C., and is preferably not less than 600° C. On the other hand, coiling at temperatures above 700° C. causes formation of pearlite and coarse TiC and tends to result in a decrease in strength. Thus, the coiling temperature is limited to not more than 700° C., and is preferably not more than 680° C.

The hot rolled steel sheet manufactured through the above steps may be subjected to a coating treatment to form a coating on the surface of the steel sheet. The types of the coatings formed on the surface are not particularly limited, and any coatings such as electroplated coatings and hot dip coatings may be applied without problems. Examples of the hot dip coatings include hot dip zinc coatings and hot dip aluminum coatings. After the hot dipping of a zinc coating, the hot dip zinc coating may be subjected to an alloying treatment to form a galvannealed zinc coating without causing any problems.

Hereinbelow, our steel sheets and methods will be described in further detail based on the EXAMPLES.

EXAMPLES

Example 1

Molten steels which had a chemical composition described in Table 1 were smelted by a usual smelting method (in a converter furnace) and were cast into slabs (steels) (thickness: 270 mm) by a continuous casting method. These slabs were heated to a heating temperature shown in Table 2, rough rolled, and finish rolled under conditions described in Table 2. After completion of the finish rolling, accelerated cooling was performed in the temperature range of down to 750° C. at an average cooling rate described in Table 2. The steel sheets were then coiled in the form of coil at a coiling temperature shown in Table 2. In this manner, hot rolled steel sheets with a sheet thickness of 2.3 mm were obtained. Some of the hot rolled steel sheets (the steel sheets Nos. 6 to 10) were pickled to remove the scales on the surface and were subjected to hot dip galvanization to form a coating on the steel sheet surface. Some of such galvanized steel sheets were subjected to an alloying treatment for the coating to form a galvannealed zinc coating. The mass of coating per unit area was 45 g/m$^2$.

With respect to the hot rolled steel sheets, a microstructure observation, a tensile test and a hole expansion test were performed. The testing methods were as follows.

(1) Microstructure Observation

A test piece for microstructure observation was sampled from the steel sheet, and a cross section parallel to the rolling direction (an L cross section) as an observation surface was polished and etched with a Nital solution. The microstructure was observed and micrographed with an optical microscope (magnification: 500 times) and a scanning electron microscope (magnification: 3000 times). The obtained micrographs of the microstructure were analyzed with an image analyzer to identify the phases and to calculate the area ratios thereof. Further, a cross section parallel to the rolling direction was specular polished and etched with a Nital etching solution to expose ferrite grains, and the microstructure was micrographed with an optical microscope (magnification: 100 times). On the obtained micrograph of the microstructure, ten straight lines were drawn with intervals of at least 100 μm in each of the rolling direction and the sheet thickness direction, and the number of intersects between grain boundaries and the straight lines was counted. The total length of the lines was divided by the number of intersects. The quotient was obtained as the length of a segment of one ferrite grain and was multiplied by 1.13 to give an ASTM ferrite grain size.

Further, a test piece for transmission electron microscope observation was sampled from the steel sheet, and was mechanically and chemically polished to give a thin film for transmission electron microscope observation. With respect to the thin film, the microstructure was observed with a transmission electron microscope (magnification: 340000 times), and five fields of view were micrographed for each sample. The obtained micrographs of the microstructure were analyzed to measure, with respect to a total of 100 TiC particles, the largest diameter d (the diameter of the widest section on the upper or the lower surface of the disk) and the diameter (thickness) t of the disk-shaped precipitate in a direction perpendicular to the upper and the lower surfaces of the disk. The arithmetic average of these diameters (average particle size ddef=(d+t)/2) was defined as the average TiC particle size of each steel sheet.

Further, a test piece for electrolytic extraction was sampled from the steel sheet. The test piece was electrolyzed in an AA electrolytic solution (AA: acetyl acetone), and the extraction residue was collected. The residue from electrolytic extraction was observed with a transmission electron microscope, and TiC was analyzed with an EDX (energy-dispersive X-ray spectrometer) to determine the Ti concentration and with an EELS (electron energy loss spectrometer) to determine the C concentration. The number ratio Ti/C of Ti atoms to C atoms in TiC was calculated.

(2) Tensile Test

From the hot rolled steel sheet, JIS No. 5 test pieces (GW: 25 mm, GL: 50 mm) were sampled such that the tensile direction would be parallel to the rolling direction. Sampling took place at two positions. One was in the middle of the width and the other was located 50 mm inward from a widthwise end, both at a distance of 150 m from an end in the longitudinal direction of the steel sheet. A single test piece was sampled from each position. With the tensile test pieces, a tensile test was performed in accordance with JIS Z2241 to measure tensile characteristics (yield strength YS, tensile strength TS). The difference in yield strength ΔYS between the widthwise central position and the widthwise end position was obtained as an indicator of strength variations. When ΔYS was 20 MPa or less, strength variations were evaluated as small, represented by ○. Larger differences were rated as ×.

(3) Hole Expansion Test

A hole expansion test piece (130×130 mm) was cut out from the hot rolled steel sheet. A central portion of the test piece was punched to create a hole 10 mm in diameter with a clearance of 12.5%. A conical punch with an apex angle of 60° was inserted along the direction in which the test piece had been punched, thereby expanding the hole. The insertion of the conical punch was terminated when a clear crack occurred through the sheet thickness. The test piece was then removed, and the diameter of the hole was measured. The difference in hole diameter between before and after the hole expansion was divided by the original diameter of the hole. The quotient was multiplied by 100 to determine the hole expansion ratio (%) as an indicator of stretch flangeability. Stretch flangeability was rated as excellent when the hole expansion ratio was 100% or above.

The results are described in Table 3.

TABLE 1

| Steel | Chemical composition (mass %) | | | | | | | | | | |
|---|---|---|---|---|---|---|---|---|---|---|---|
| No. | C | Si | Mn | P | S | Al | N | Ti | B | Others | Remarks |
| A | 0.002 | 0.01 | 0.45 | 0.005 | 0.0008 | 0.045 | 0.0038 | 0.075 | — | — | Comp. steel |
| B | 0.015 | 0.01 | 0.45 | 0.005 | 0.0007 | 0.041 | 0.0035 | 0.075 | — | — | Inv. steel |
| C | 0.025 | 0.01 | 0.46 | 0.005 | 0.0008 | 0.042 | 0.0038 | 0.075 | — | — | Inv. steel |
| D | 0.035 | 0.01 | 0.45 | 0.005 | 0.0007 | 0.048 | 0.0041 | 0.076 | — | — | Inv. steel |
| E | 0.075 | 0.01 | 0.45 | 0.005 | 0.0008 | 0.045 | 0.0038 | 0.075 | — | — | Comp. steel |
| F | 0.031 | 0.04 | 0.05 | 0.006 | 0.0025 | 0.038 | 0.0042 | 0.085 | — | — | Inv. steel |
| G | 0.031 | 0.04 | 0.12 | 0.006 | 0.0024 | 0.038 | 0.0041 | 0.085 | — | — | Inv. steel |
| H | 0.031 | 0.02 | 0.25 | 0.006 | 0.0026 | 0.037 | 0.0043 | 0.086 | — | — | Inv. steel |
| I | 0.031 | 0.04 | 0.48 | 0.007 | 0.0024 | 0.038 | 0.0041 | 0.085 | — | — | Inv. steel |
| J | 0.031 | 0.04 | 0.95 | 0.006 | 0.0025 | 0.038 | 0.0042 | 0.084 | — | — | Comp. steel |
| K | 0.028 | 0.01 | 0.38 | 0.012 | 0.0030 | 0.052 | 0.0034 | 0.013 | 0.0015 | — | Comp. steel |
| L | 0.028 | 0.01 | 0.38 | 0.012 | 0.0028 | 0.054 | 0.0035 | 0.068 | 0.0016 | — | Inv. steel |
| M | 0.028 | 0.01 | 0.38 | 0.012 | 0.0027 | 0.053 | 0.0032 | 0.072 | 0.0014 | — | Inv. steel |
| N | 0.028 | 0.01 | 0.37 | 0.012 | 0.0028 | 0.051 | 0.0031 | 0.085 | 0.0015 | — | Inv. steel |
| O | 0.028 | 0.01 | 0.38 | 0.012 | 0.0028 | 0.052 | 0.0033 | 0.12 | 0.0015 | — | Comp. steel |
| P | 0.031 | 0.05 | 0.41 | 0.024 | 0.0009 | 0.061 | 0.0041 | 0.084 | 0.0010 | — | Inv. steel |
| Q | 0.031 | 0.04 | 0.41 | 0.021 | 0.0009 | 0.062 | 0.0042 | 0.085 | 0.0011 | — | Inv. steel |
| R | 0.032 | 0.03 | 0.41 | 0.024 | 0.0009 | 0.063 | 0.0042 | 0.084 | 0.0010 | — | Inv. steel |
| S | 0.028 | 0.05 | 0.33 | 0.024 | 0.0018 | 0.038 | 0.0038 | 0.085 | — | | Inv. steel |
| T | 0.028 | 0.09 | 0.35 | 0.022 | 0.0019 | 0.037 | 0.0032 | 0.084 | — | — | Inv. steel |
| U | 0.028 | 0.08 | 0.34 | 0.025 | 0.0017 | 0.038 | 0.0031 | 0.085 | — | — | Inv. steel |
| V | 0.028 | 0.35 | 1.50 | 0.024 | 0.0010 | 0.025 | 0.0041 | 0.15 | — | — | Comp. steel |
| W | 0.050 | 0.68 | 1.59 | 0.017 | 0.0020 | 0.036 | 0.0041 | 0.22 | — | — | Comp. steel |
| X | 0.031 | 1.02 | 1.49 | 0.011 | 0.0010 | 0.028 | 0.0025 | 0.11 | — | — | Comp. steel |
| Y | 0.025 | 1.12 | 0.61 | 0.010 | 0.0015 | 0.038 | 0.0031 | 0.091 | — | | Comp. steel |
| Z | 0.017 | 0.01 | 0.45 | 0.005 | 0.0008 | 0.045 | 0.0038 | 0.075 | — | Cs: 0.0025, Zn: 0.0015 | Inv. steel |
| 1A | 0.015 | 0.01 | 0.45 | 0.005 | 0.0007 | 0.041 | 0.0035 | 0.075 | — | Cu: 0.1, Ni: 0.15, Sn: 0.0012 | Inv. steel |
| 2A | 0.025 | 0.01 | 0.46 | 0.005 | 0.0008 | 0.042 | 0.0038 | 0.075 | — | Sn: 0.012, Cu: 0.16 | Inv. steel |
| 3A | 0.035 | 0.01 | 0.45 | 0.005 | 0.0007 | 0.048 | 0.0041 | 0.076 | — | Ca: 0.0012, Pb: 0.012 | Inv. steel |
| 4A | 0.075 | 0.01 | 0.45 | 0.005 | 0.0008 | 0.045 | 0.0038 | 0.075 | — | Mo: 0.12, Cr: 0.04, W: 0.011 | Inv. steel |
| 5A | 0.031 | 0.04 | 0.05 | 0.006 | 0.0025 | 0.038 | 0.0042 | 0.085 | — | As: 0.0008, Sb: 0.0073 | Inv. steel |
| 6A | 0.031 | 0.04 | 0.12 | 0.006 | 0.0024 | 0.038 | 0.0041 | 0.085 | — | Co: 0.0056, Mg: 0.0008, Ta: 0.0021 | Inv. steel |
| 7A | 0.031 | 0.01 | 0.45 | 0.011 | 0.0010 | 0.028 | 0.0025 | 0.075 | — | V: 0.03, Nb: 0.02, Zr: 0.0015, REM: 0.012 | Inv. steel |

TABLE 2

| Steel sheet No. | Steel No. | Hot rolling: Heating temp. (° C.) | Finishing delivery temp. (° C.) | Average cooling rate* (° C./s) | Coiling temp. (° C.) | Remarks |
|---|---|---|---|---|---|---|
| 1 | A | 1250 | 910 | 55 | 620 | Comp. Ex. Ex. |
| 2 | B | 1250 | 910 | 55 | 620 | Inv. Ex. |
| 3 | C | 1250 | 910 | 55 | 620 | Inv. Ex. |
| 4 | D | 1250 | 910 | 55 | 620 | Inv. Ex. |
| 5 | E | 1250 | 910 | 55 | 620 | Comp. Ex. Ex. |
| 6 | F | 1250 | 930 | 60 | 670 | Inv. Ex. |
| 7 | G | 1250 | 930 | 60 | 670 | Inv. Ex. |
| 8 | H | 1250 | 930 | 60 | 670 | Inv. Ex. |
| 9 | I | 1250 | 930 | 60 | 670 | Inv. Ex. |
| 10 | J | 1250 | 930 | 60 | 670 | Comp. Ex. Ex. |
| 11 | K | 1230 | 900 | 80 | 640 | Comp. Ex. Ex. |
| 12 | L | 1230 | 800 | 80 | 640 | Comp. Ex. Ex. |
| 13 | M | 1230 | 900 | 80 | 640 | Inv. Ex. |
| 14 | N | 1230 | 900 | 80 | 640 | Inv. Ex. |
| 15 | O | 1230 | 900 | 80 | 640 | Comp. Ex. Ex. |
| 16 | P | 1260 | 940 | 100 | 630 | Inv. Ex. |
| 17 | Q | 1260 | 940 | 100 | 630 | Inv. Ex. |
| 18 | R | 1260 | 940 | 100 | 630 | Inv. Ex. |
| 19 | S | 1240 | 940 | 120 | 630 | Inv. Ex. |
| 20 | T | 1240 | 940 | 120 | 630 | Inv. Ex. |
| 21 | U | 1240 | 940 | 60 | 500 | Comp. Ex. Ex. |
| 22 | V | 1230 | 895 | 75 | 620 | Comp. Ex. Ex. |
| 23 | W | 1200 | 850 | 200 | 500 | Comp. Ex. Ex. |
| 24 | X | 1200 | 870 | 11 | 640 | Comp. Ex. Ex. |

TABLE 2-continued

| Steel sheet No. | Steel No. | Hot rolling: Heating temp. (° C.) | Finishing delivery temp. (° C.) | Average cooling rate* (° C./s) | Coiling temp. (° C.) | Remarks |
|---|---|---|---|---|---|---|
| 25 | Y | 1260 | 920 | 65 | 620 | Comp. Ex. Ex. |
| 26 | Z | 1250 | 910 | 65 | 620 | Inv. Ex. |
| 27 | 1A | 1250 | 930 | 80 | 650 | Inv. Ex. |
| 28 | 2A | 1260 | 910 | 120 | 630 | Inv. Ex. |
| 29 | 3A | 1250 | 925 | 160 | 640 | Inv. Ex. |
| 30 | 4A | 1250 | 930 | 140 | 680 | Inv. Ex. |
| 31 | 5A | 1250 | 930 | 85 | 610 | Inv. Ex. |
| 32 | 6A | 1250 | 940 | 90 | 620 | Inv. Ex. |
| 33 | 7A | 1200 | 930 | 75 | 630 | Inv. Ex. |
| 34 | I | 1250 | 930 | 60 | 670 | Inv. Ex. |
| 35 | I | 1250 | 1070 | 60 | 640 | Comp. Ex. Ex. |
| 36 | I | 1250 | 930 | 15 | 640 | Comp. Ex. Ex. |
| 37 | I | 1250 | 930 | 60 | 490 | Comp. Ex. Ex. |
| 38 | I | 1250 | 930 | 60 | 780 | Comp. Ex. Ex. |

*Average in the temperature range from a temperature after completion of finish rolling to 750° C.

TABLE 3

| Steel sheet No. | Steel No. | Microstructure: Phases* | F fraction (area %) | F crystal grain size (mm) | TiC size (nm) | Ti/C** | Tensile characteristics: Yield strength YS (MPa) | Tensile characteristics: Tensile strength TS (MPa) | Stretch flangeability: Hole expansion ratio (%) | Strength variations: Difference in strength in width direction DYS*** (MPa) | Rating | Remarks |
|---|---|---|---|---|---|---|---|---|---|---|---|---|
| 1 | A | F | 100 | 23 | 13 | 1.2 | 275 | 302 | 195 | 21 | x | Comp. Ex. |
| 2 | B | F | 100 | 8 | 2 | 0.9 | 569 | 625 | 112 | 8 | ○ | Inv. Ex. |
| 3 | C | F | 100 | 5 | 3 | 0.8 | 578 | 635 | 110 | 3 | ○ | Inv. Ex. |
| 4 | D | F | 100 | 6 | 3 | 0.8 | 586 | 644 | 105 | 3 | ○ | Inv. Ex. |
| 5 | E | F + P | 85 | 10 | 4 | 0.8 | 532 | 585 | 60 | 55 | x | Comp. Ex. |
| 6 | F | F + P | 96 | 15 | 3 | 0.8 | 531 | 540 | 140 | 3 | ○ | Inv. Ex. |
| 7 | G | F | 100 | 5 | 3 | 0.8 | 548 | 602 | 115 | 8 | ○ | Inv. Ex. |
| 8 | H | F | 100 | 4 | 3 | 0.8 | 551 | 605 | 110 | 5 | ○ | Inv. Ex. |
| 9 | I | F | 100 | 3 | 4 | 0.9 | 555 | 610 | 110 | 4 | ○ | Inv. Ex. |
| 10 | J | F + P | 80 | 4 | 4 | 1.3 | 642 | 706 | 45 | 26 | x | Comp. Ex. |
| 11 | K | F + P | 85 | 21 | — | — | 355 | 390 | 45 | 31 | x | Comp. Ex. |
| 12 | L | F | 100 | 0.7 | 2 | 0.7 | 532 | 585 | 86 | 35 | x | Comp. Ex. |
| 13 | M | F | 100 | 4 | 3 | 0.7 | 578 | 635 | 114 | 5 | ○ | Inv. Ex. |
| 14 | N | F | 100 | 4 | 3 | 0.7 | 576 | 633 | 116 | 5 | ○ | Inv. Ex. |
| 15 | O | F | 100 | 4 | 23 | 1.3 | 504 | 554 | 95 | 25 | x | Comp. Ex. |
| 16 | P | F | 100 | 5 | 4 | 0.8 | 578 | 635 | 110 | 5 | ○ | Inv. Ex. |
| 17 | Q | F | 100 | 5 | 4 | 0.8 | 581 | 638 | 121 | 4 | ○ | Inv. Ex. |
| 18 | R | F | 100 | 5 | 4 | 0.8 | 577 | 634 | 105 | 3 | ○ | Inv. Ex. |
| 19 | S | F | 100 | 6 | 4 | 0.8 | 553 | 608 | 111 | 0 | ○ | Inv. Ex. |
| 20 | T | F | 100 | 5 | 4 | 0.8 | 560 | 615 | 108 | 1 | ○ | Inv. Ex. |
| 21 | U | F + P | 20 | 0.7 | 2 | 1.1 | 487 | 535 | 54 | 48 | x | Comp. Ex. |
| 22 | V | F + P | 80 | 15 | 11 | 1.2 | 558 | 613 | 41 | 47 | x | Comp. Ex. |
| 23 | W | F + B | 10 | 0.8 | — | — | 660 | 725 | 54 | 45 | x | Comp. Ex. |
| 24 | X | F + P | 80 | 34 | 16 | 1.2 | 642 | 706 | 49 | 55 | x | Comp. Ex. |
| 25 | Y | F + P | 90 | 11 | 12 | 1.1 | 523 | 561 | 85 | 33 | x | Comp. Ex. |
| 26 | Z | F | 100 | 5 | 2 | 0.8 | 560 | 615 | 130 | 8 | ○ | Inv. Ex. |
| 27 | lA | F | 100 | 6 | 3 | 0.9 | 580 | 637 | 120 | 7 | ○ | Inv. Ex. |
| 28 | 2A | F | 100 | 5 | 2 | 0.8 | 570 | 626 | 115 | 5 | ○ | Inv. Ex. |
| 29 | 3A | F | 100 | 4 | 3 | 0.8 | 566 | 622 | 130 | 6 | ○ | Inv. Ex. |
| 30 | 4A | F | 100 | 5 | 4 | 0.8 | 541 | 595 | 125 | 9 | ○ | Inv. Ex. |
| 31 | SA | F | 100 | 3 | 2 | 0.9 | 561 | 616 | 130 | 3 | ○ | Inv. Ex. |
| 32 | 6A | F | 100 | 4 | 3 | 0.8 | 532 | 585 | 145 | 5 | ○ | Inv. Ex. |
| 33 | 7A | F | 100 | 5 | 2 | 0.8 | 588 | 646 | 110 | 7 | ○ | Inv. Ex. |
| 34 | I | F | 100 | 3 | 4 | 0.9 | 555 | 610 | 110 | 4 | ○ | Inv. Ex. |
| 35 | I | F | 100 | 15 | 12 | 1.2 | 510 | 575 | 95 | 31 | x | Comp. Ex. |
| 36 | I | F + P | 94 | 14 | 15 | 1.1 | 475 | 560 | 90 | 35 | x | Comp. Ex. |
| 37 | I | F + B | 80 | 5 | 4 | 0.8 | 477 | 570 | 65 | 39 | x | Comp. Ex. |
| 38 | I | F + P | 88 | 16 | 18 | 1.3 | 433 | 525 | 55 | 40 | x | Comp. Ex. |

*F: ferrite, P: pearlite, B: bainite

**Number ratio of Ti atoms to C atoms in TiC.

***Difference in yield strength between in the middle of width and at 50 mm inward from a widthwise end of steel sheet.

All of the hot rolled steel sheets in our Examples showed high strength and excellent stretch flangeability. Specifically, these steel sheets exhibited a high strength of not less than 530 MPa in terms of yield strength YS, and had ΔYS of not more than 20 MPa achieving small variations in strength in the width direction. In addition to such small variations in mechanical properties in the coil, the steel sheets showed a hole expansion ratio of not less than 100%. In contrast, Comparative Examples which are outside our scope resulted in any or all of less than 530 MPa yield strength YS, ΔYS in excess of 20 MPa, namely, large variations in strength in the width direction, and poor stretch flangeability with a hole expansion ratio of less than 100%.

Example 2

Molten steels which had chemical compositions similar to those of the steels No. H and No. M described in Table 1 were smelted in a converter furnace, and were cast into slabs (thickness: 270 mm) by a continuous casting method similarly to EXAMPLE 1. These slabs were heated, rough rolled and finish rolled under similar conditions to the steel sheets No. 8 and No. 12 described in Table 2. The steel sheets were cooled by accelerated cooling and coiled into coils. Thus, hot rolled steel sheets with a sheet thickness of 2.6 mm were obtained. From widthwise central portions of the coils, JIS No. 5 tensile test pieces and hole expansion test pieces were sampled at respective distances in the longitudinal direction shown in Table 4 and were tested by the tensile test and the hole expansion test under the similar conditions as in EXAMPLE 1. The results are described in Table 4. The results also show the difference in yield strength ΔYS between the value at a distance of 40 m in the longitudinal direction as a reference and each of the values at the respective distances in the longitudinal direction.

TABLE 4

| Steel sheet No. | Steel No. | Distances in longitudinal direction (m) | Mechanical properties YS (MPa) | DYS* | TS (MPa) | Hole expansion ratio (%) | Rating | Remarks |
|---|---|---|---|---|---|---|---|---|
| 39 | H | 40 | 550 | — | 606 | 125 | ○ | Inv. Ex. |
| 40 | | 100 | 551 | −1 | 605 | 120 | ○ | Inv. Ex. |
| 41 | | 300 | 548 | 2 | 602 | 124 | ○ | Inv. Ex. |
| 42 | | 500 | 552 | −2 | 607 | 128 | ○ | Inv. Ex. |
| 43 | | 700 | 551 | −1 | 605 | 121 | ○ | Inv. Ex. |
| 44 | M | 40 | 581 | — | 630 | 110 | ○ | Inv. Ex. |
| 45 | | 100 | 582 | −1 | 632 | 110 | ○ | Inv. Ex. |
| 46 | | 300 | 585 | −4 | 633 | 118 | ○ | Inv. Ex. |
| 47 | | 500 | 581 | 0 | 628 | 116 | ○ | Inv. Ex. |
| 48 | | 700 | 581 | 0 | 631 | 109 | ○ | Inv. Ex. |

*Difference in yield strength between at distance of 40 m in the longitudinal direction as reference and respective distances in the longitudinal direction.

Both of the coils were demonstrated to have small variations in mechanical properties in the longitudinal direction.

The invention claimed is:

1. A method of manufacturing a high-strength hot rolled steel sheet with a yield strength of not less than 530 MPa by hot rolling a steel, wherein the steel has a chemical composition including, by mass %:

C: more than 0.010% and not more than 0.06%,

Si: not more than 0.3%,

Mn: not more than 0.8%,

P: not more than 0.03%,

S: not more than 0.02%,

Al: not more than 0.1%,

N: not more than 0.01% and Ti: 0.05 to 0.10%, the balance comprising Fe and inevitable impurities, the method comprising:

rough rolling the steel in an austenite single phase region, finish rolling the resultant steel sheet after rough rolling at a finishing delivery temperature of 860° C. to 1050° C., cooling the steel sheet at an average cooling rate of not less than 30° C./s in a temperature range of from a temperature after the completion of the finish rolling to 750° C., and coiling the steel sheet into a coil at a coiling temperature of 580° C. to 700° C., wherein the steel sheet includes a metal microstructure in which a ferrite phase represents an area ratio of not less than 95%, ferrite crystal grains in the ferrite phase have an average crystal grain size of not less than 1 μm, the ferrite crystal grains contain TiC precipitate particles with an average particle size of not more than 7 nm dispersed in the ferrite crystal grains, and a ratio of the number of Ti atoms to the number of C atoms, Ti/C, in TiC is less than 1.

2. The method according to claim 1, wherein the chemical composition further includes, by mass %, B: not more than 0.0020%.

3. The method according to claim 1, wherein the chemical composition further includes, by mass %, one or more selected from the group consisting of Cu, Ni, Cr, Co, Mo, Sb, W, As, Pb, Mg, Ca, Sn, Ta, Nb, V, REM, Cs, Zr and Zn in a total content of not more than 1%.

4. The method according to claim 2, wherein the chemical composition further includes, by mass %, one or more selected from the group consisting of Cu, Ni, Cr, Co, Mo, Sb, W, As, Pb, Mg, Ca, Sn, Ta, Nb, V, REM, Cs, Zr and Zn in a total content of not more than 1%.

* * * * *